US009464543B2

(12) United States Patent
Kobayashi et al.

(10) Patent No.: US 9,464,543 B2
(45) Date of Patent: Oct. 11, 2016

(54) VALVE OPENING/CLOSING TIMING CONTROL DEVICE

(71) Applicant: AISIN SEIKI KABUSHIKI KAISHA, Kariya-shi, Aichi (JP)

(72) Inventors: Masaki Kobayashi, Okazaki (JP); Kazuo Ueda, Gamagori (JP)

(73) Assignee: AISIN SEIKI KABUSHIKI KAISHA, Kariya, Aichi (JP)

( * ) Notice: Subject to any disclaimer, the term of this patent is extended or adjusted under 35 U.S.C. 154(b) by 0 days.

(21) Appl. No.: 14/772,226

(22) PCT Filed: Mar. 6, 2014

(86) PCT No.: PCT/JP2014/055779

§ 371 (c)(1),
(2) Date: Sep. 2, 2015

(87) PCT Pub. No.: WO2014/192355

PCT Pub. Date: Dec. 4, 2014

(65) Prior Publication Data

US 2016/0017770 A1 Jan. 21, 2016

(30) Foreign Application Priority Data

May 30, 2013 (JP) ..... 2013-114303

(51) Int. Cl.
*F01L 1/34* (2006.01)
*F01L 1/344* (2006.01)

(52) U.S. Cl.
CPC .... *F01L 1/3442* (2013.01); *F01L 2001/34426* (2013.01); *F01L 2001/34459* (2013.01); *F01L 2001/34473* (2013.01); *F01L 2001/34476* (2013.01)

(58) Field of Classification Search
CPC ..... F01L 1/3442; F01L 2001/34426; F01L 2001/34476; F01L 2001/34473; F01L 2001/34459
USPC ..... 123/90.15, 90.17
See application file for complete search history.

(56) References Cited

U.S. PATENT DOCUMENTS 6,397,803 B1 6/2002 Fujiwara et al.
7,536,985 B2 * 5/2009 Suzuki ..... F01L 1/022 123/90.15

(Continued)

FOREIGN PATENT DOCUMENTS

JP 2002-250240 A 9/2002
JP 2002-349220 A 12/2002

(Continued)

OTHER PUBLICATIONS

Notification of Transmittal of the Translation of the International Search Report (Forms PCT/IB/338 and Forms PCT/IB/373) and the Written Opinion of the International Searching Authority (Forms PCT/ISA/237) issued on Dec. 10, 2015, by the International Bureau of WIPO in corresponding International Application No. PCT/JP2014/055779. (6 pgs).

(Continued)

*Primary Examiner* — Zelalem Eshete
(74) *Attorney, Agent, or Firm* — Buchanan Ingersoll & Rooney PC

(57) ABSTRACT

In a valve opening/closing timing control device, a fluid pressure chamber formed by a drive-side rotating and a driven-side rotating body is divided into an advance chamber and a delay chamber. The valve opening/closing timing control device includes an intermediate lock mechanism; an electromagnetic valve; a phase detection sensor; and a control unit that issues a command to the electromagnetic valve to switch a working fluid supply destination to a working fluid supply destination at which the driven-side rotating body shifts to an intermediate lock phase, when a relative rotation phase at the startup of an engine is positioned toward a most delayed phase or a most advanced phase with respect to the intermediate lock phase in case of the electromagnetic valve that sets the working fluid supply destination to the delay chamber or the advance chamber when supply of electric power to the electromagnetic valve is stopped.

5 Claims, 8 Drawing Sheets

(56) References Cited

U.S. PATENT DOCUMENTS

| | | | |
|---|---|---|---|
| 2005/0016481 | A1 | 1/2005 | Komazawa et al. |
| 2006/0124094 | A1 | 6/2006 | Kanada et al. |
| 2011/0162606 | A1 | 7/2011 | Kaneko |

FOREIGN PATENT DOCUMENTS

| | | | |
|---|---|---|---|
| JP | 2006-170025 | A | 6/2006 |
| JP | 2007-154748 | A | 6/2007 |
| JP | 4000522 | B2 | 10/2007 |
| JP | 2010-223172 | A | 10/2010 |

OTHER PUBLICATIONS

International Search Report (PCT/ISA/210) mailed on Apr. 22, 2014, by the Japanese Patent Office as the International Searching Authority for International Application No. PCT/JP2014/055779.
Written Opinion (PCT/ISA/237) mailed on Apr. 22, 2014, by the Japanese Patent Office as the International Searching Authority for International Application No. PCT/JP2014/055779.

* cited by examiner

VALVE OPENING/CLOSING TIMING CONTROL DEVICE

TECHNICAL FIELD

The present invention relates to a valve opening/closing timing control device that includes a drive-side rotating body that rotates synchronously with a crankshaft of an internal combustion engine, and a driven-side rotating body that rotates synchronously with a valve opening/closing camshaft in the internal combustion engine. The valve opening/closing timing control device controls opening/closing timing of an intake valve or an exhaust valve by changing a relative rotation phase of the driven-side rotating body with respect to the drive-side rotating body.

BACKGROUND ART

The above valve opening/closing timing control device, ordinarily, changes the relative rotation phase of the driven-side rotating body with respect to the drive-side rotating body by switching a supply destination of a working fluid that was discharged from a fluid pump to an advance chamber or a delay chamber by operation of an electromagnetic valve.

The relative rotation phase is changed to an advance side when the working fluid is supplied to the advance chamber, and the relative rotation phase is changed to a delay side when the working fluid is supplied to the delay chamber.

The optimal opening/closing timing of the intake valve or the exhaust valve differs depending on the running circumstances of the engine, such as when starting the engine or during vehicle running. For example, it is possible to set the opening/closing timing of the intake valve or the exhaust valve to a timing that is optimal when starting the engine by restricting the relative rotation phase during an engine stoppage to an intermediate lock phase between a most advanced phase and a most delayed phase.

Patent Document 1 and Patent Document 2 disclose a valve opening/closing timing control device provided with a fluid pressure chamber formed as a section between a drive-side rotating body and a driven-side rotating body, an advance chamber and a delay chamber formed by dividing a fluid pressure chamber with a dividing portion, an advance channel that supplies/drains a working fluid to/from the advance chamber, a delay channel that supplies/drains the working fluid to/from the delay chamber, an intermediate lock mechanism capable of switching between a locked state that restricts a relative rotation phase of the driven-side rotating body with respect to the drive-side rotating body to an intermediate lock phase and an unlocked state in which the restriction has been released, and an electromagnetic valve capable of switching a supply destination of working fluid that has been discharged from a fluid pump to the advance chamber or the delay chamber by a power source switching on/off.

With the electromagnetic valve provided in the valve opening/closing timing control device in Patent Document 1, the supply destination of the working fluid that has been discharged from the fluid pump is switched to the delay chamber when the power source switches off.

With the electromagnetic valve provided in the valve opening/closing timing control device in Patent Document 2, the supply destination of the working fluid that has been discharged from the fluid pump is switched to the advance chamber when the power source switches off.

CITATION LIST

Patent Literature

Patent Document 1: Japanese Patent No. 4000522
Patent Document 2: JP 2010-223172A

SUMMARY OF INVENTION

Technical Problem

With the above valve opening/closing timing control device, there are cases when the relative rotation phase during an engine stoppage cannot be restricted to the intermediate lock phase, for example when there is a sudden engine stoppage such as an engine stall.

With the electromagnetic valve provided in the valve opening/closing timing control device disclosed in Patent Document 1, the working fluid supply destination is switched to the delay chamber by the power source switching off due to an engine stoppage.

Therefore, when the engine stops in a state in which the relative rotation phase has been held at a phase on the delay side relative to the intermediate lock phase, when starting the engine the working fluid is supplied to the delay chamber and the relative rotation phase moves to the delay side which is opposite to the side of the intermediate lock phase, so the relative rotation phase cannot be restricted to the intermediate lock phase and thus engine starting properties decrease.

With the electromagnetic valve provided in the valve opening/closing timing control device disclosed in Patent Document 2, the working fluid supply destination is switched to the advance chamber by the power source switching off due to an engine stoppage.

Therefore, when the engine stops in a state in which the relative rotation phase has been held at a phase on the advance side relative to the intermediate lock phase, when starting the engine the working fluid is supplied to the advance chamber and the relative rotation phase moves to the advance side which is opposite to the side of the intermediate lock phase, so engine starting properties decrease in this case as well.

The present invention was made in consideration of the foregoing circumstances, and it is an object thereof to provide a valve opening/closing timing control device that, even in a case where the relative rotation phase cannot be restricted to the intermediate lock phase during a stoppage of the internal combustion engine, can ensure good starting properties by restricting the relative rotation phase to the intermediate lock phase when starting the internal combustion engine.

Solution to Problem

In a characteristic configuration, a valve opening/closing timing control device according to the present invention includes a drive-side rotating body that rotates synchronously with a crankshaft of an internal combustion engine; a driven-side rotating body that is disposed coaxially to the drive-side rotating body and rotates synchronously with a valve opening/closing camshaft of the internal combustion engine; a fluid pressure chamber that is formed as a section between the drive-side rotating body and the driven-side rotating body; an advance chamber and a delay chamber that are formed by dividing the fluid pressure chamber with a dividing portion that has been provided in at least one of the drive-side rotating body and the driven-side rotating body; an advance channel that selectively permits supply of a working fluid to the advance chamber and outflow of the working fluid from the advance chamber; a delay channel that selectively permits supply of the working fluid to the delay chamber and outflow of the working fluid from the delay chamber; an intermediate lock mechanism that is capable of selectively switching between a locked state in which a relative rotation phase of the driven-side rotating body with respect to the drive-side rotating body is restricted to an intermediate lock phase between a most advanced phase and a most delayed phase, and an unlocked state in which the restriction has been released; an electromagnetic valve that is capable of selectively switching a supply destination of a working fluid that has been discharged from a fluid pump to the advance chamber or the delay chamber according to the strength of electric current of a power source; a phase detection sensor that is capable of detecting the relative rotation phase; and a control unit that issues a command to the electromagnetic valve to switch the working fluid supply destination to a working fluid supply destination at which the driven-side rotating body shifts toward the intermediate lock phase, in a case where supply of electric power to the electromagnetic valve is stopped and the working fluid supply destination is the delay chamber, when the relative rotation phase that has been detected by the phase detection sensor when starting the internal combustion engine is positioned toward the most delayed phase with respect to the intermediate lock phase, or in a case where the supply of electric power to the electromagnetic valve is stopped and the working fluid supply destination is the advance chamber, when the relative rotation phase that has been detected by the phase detection sensor when starting the internal combustion engine is positioned toward the most advanced phase with respect to the intermediate lock phase.

The valve opening/closing timing control device having this configuration includes a phase detection sensor that is capable of detecting the relative rotation phase of the driven-side rotating body with respect to the drive-side rotating body, and a control unit that issues a command to the electromagnetic valve to switch the working fluid supply destination to a working fluid supply destination at which the driven-side rotating body shifts toward the intermediate lock phase, in a case where a power source of the electromagnetic valve is switched off and the working fluid supply destination is the delay chamber, when the relative rotation phase when starting the internal combustion engine is positioned toward the most delayed phase with respect to the intermediate lock phase, or in a case where the power source of the electromagnetic valve is switched off and the working fluid supply destination is the advance chamber, when the relative rotation phase when starting the internal combustion engine is positioned toward the most advanced phase with respect to the intermediate lock phase.

Therefore, in a case where the power source of the electromagnetic valve is switched off and the working fluid supply destination is the delay chamber, even if the relative rotation phase when starting the internal combustion engine is positioned toward the most delayed phase with respect to the intermediate lock phase, it is possible to switch the working fluid supply destination to the supply destination where the driven-side rotating body shifts toward the intermediate lock phase, thus causing the relative rotation phase to move to the side of the intermediate lock phase.

Also, in a case where the power source of the electromagnetic valve is switched off and the working fluid supply destination is the advance chamber, even if the relative rotation phase when starting the internal combustion engine is positioned toward the advanced phase with respect to the intermediate lock phase, it is possible to switch the working fluid supply destination to the supply destination where the driven-side rotating body shifts toward the intermediate lock phase, thus causing the relative rotation phase to move to the side of the intermediate lock phase.

Accordingly, with the valve opening/closing timing control device having this configuration, even in a case where the relative rotation phase cannot be restricted to the intermediate lock phase during a stoppage of the internal combustion engine, when starting the internal combustion engine the relative rotation phase can be moved to the intermediate lock phase and then restricted there, so good starting properties can be ensured.

In another characteristic configuration of the present invention, the valve opening/closing timing control device includes a non-return valve that blocks flow of the working fluid from the electromagnetic valve to the fluid pump.

With this configuration, when a supply destination of the working fluid that has been discharged from the fluid pump exists other than the advance chamber or the delay chamber, even if there are fluctuations in the amount of the working fluid supplied to the supply destination other than the advance chamber or the delay chamber, fluctuations in the fluid pressure of the working fluid in the advance chamber or the delay chamber are prevented, so the relative rotation phase can be easily stabilized at a desired phase.

The intermediate lock mechanism, for example, has a lock member provided in any one of the drive-side rotating body and the driven-side rotating body; a recess provided in the other of the drive-side rotating body and the driven-side rotating body; a biasing member that biases the lock member to protrude outward and enter into the recess; and a lock release channel that supplies a lock release working fluid to the recess. The intermediate lock mechanism is configured to be capable of switching between a locked state in which the relative rotation phase is restricted to the intermediate lock phase by the lock member entering into the recess due to the biasing force of the biasing member, and an unlocked state, by the lock member that entered into the recess withdrawing from the recess by acting against the biasing force of the biasing member due to the fluid pressure of the working fluid that has been supplied from the lock release channel to the recess. The lock release channel is connected to a fluid pump that discharges the working fluid supplied to the advance chamber or the delay chamber. In this case, by branching the lock release channel to connect to a channel portion that connects the fluid pump with the non-return valve, it is possible to prevent a problem of the intermediate lock mechanism accidentally switching to the locked state.

More specifically, in a case where a non-return valve that blocks flow of the working fluid from the electromagnetic valve to the fluid pump is not provided, there is a risk that pulsing of the working fluid in the advance chamber or the delay chamber caused by camshaft torque fluctuation or the like will be transmitted to the lock release working fluid that has been supplied to the recess via the lock release channel.

When pulsing of the working fluid in the advance chamber or the delay chamber is transmitted to the lock release working fluid, there is a risk that the lock member in the unlocked state will enter into the recess due to the biasing force of the biasing member at a time when the fluid pressure of the lock release working fluid decreased, and thus the intermediate lock mechanism will accidentally switch to the locked state.

In contrast with the above, in a case where a non-return valve that blocks flow of the working fluid from the electromagnetic valve to the fluid pump is provided as in the present configuration, the lock release channel is branched to connect to a channel portion that connects the fluid pump with the non-return valve, so transmission of pulsing of the working fluid in the advance chamber or the delay chamber to the lock release working fluid that has been supplied to the recess can be prevented. Thus, it is possible to prevent a problem of the intermediate lock mechanism accidentally switching to the locked state.

On the other hand, in a state in which the relative rotation phase is positioned toward the most delayed phase with respect to the intermediate lock phase, the working fluid has flowed into the delay chamber, and in a state in which the relative rotation phase is positioned toward the most advanced phase with respect to the intermediate lock phase, the working fluid has flowed into the advance chamber.

Therefore, in a case where a non-return valve is provided as in the present configuration, the working fluid that has flowed into the advance chamber or the delay chamber is likely to remain there. When the working fluid remains in the delay chamber, that working fluid remaining in the delay chamber becomes resistance, so that it is difficult to move the relative rotation phase to the advance side. Also, when the working fluid remains in the advance chamber, that working fluid remaining in the advance chamber becomes resistance, so that it is difficult to move the relative rotation phase to the delay side.

With the valve opening/closing timing control device of the present configuration, even in such a case, the working fluid that is remaining in the advance chamber or the delay chamber, for example, is proactively caused to leak out from a gap existing at an interface or the like of the drive-side rotating body and the driven-side rotating body, so the relative rotation phase can easily be moved quickly to the intermediate lock phase.

That is, in a case where the power source of the electromagnetic valve is switched off and the supply destination is the delay chamber, in a state in which the relative rotation phase when starting the internal combustion engine is positioned toward the most delayed phase with respect to the intermediate lock phase and the working fluid is likely to remain in the delay chamber, it is possible to switch the working fluid supply destination to the advance chamber.

Accordingly, the working fluid that is remaining in the delay chamber is proactively caused to leak out from a gap or the like by applying pressure with the fluid pressure of the working fluid that has been supplied to the advance chamber, so the relative rotation phase can easily be moved quickly to the intermediate lock phase.

Also, in a case where the power source of the electromagnetic valve is switched off and the supply destination is the advance chamber, in a state in which the relative rotation phase detected when starting the internal combustion engine is positioned toward the most advanced phase with respect to the intermediate lock phase and the working fluid is likely to remain in the advance chamber, it is possible to switch the working fluid supply destination to the delay chamber.

Accordingly, the working fluid that is remaining in the advance chamber is proactively caused to leak out from a gap by applying pressure with the fluid pressure of the working fluid that has been supplied to the delay chamber, so the relative rotation phase can easily be moved quickly to the intermediate lock phase.

In another characteristic configuration of the present invention, the control unit stops the supply of electric power to the electromagnetic valve when the driven-side rotating body has passed the intermediate lock phase due to the working fluid supply destination having been switched to the working fluid supply destination at which the driven-side rotating body shifts toward the intermediate lock phase.

There are cases when as a result of applying to the electromagnetic valve an electric current that switches the working fluid supply destination to the working fluid supply destination at which the driven-side rotating body shifts toward the intermediate lock phase, the relative rotation phase overshoots past the intermediate lock phase. In such a case, with the present configuration it is possible to switch off the power source of the electromagnetic valve to switch the working fluid supply destination such that the relative rotation phase returns to the intermediate lock phase, so the relative rotation phase can easily be moved reliably to the intermediate lock phase.

In another characteristic configuration of the present invention, the valve opening/closing timing control device includes a recess provided in the driven-side rotating body; a lock release channel that links the fluid pump with the recess; and a lock control valve that, in response to a supplied electric current, is capable of switching between an unlocked position that is a state in which the working fluid that has been discharged from the fluid pump is supplied from the lock release channel to the recess, and a locked position that is a state in which the working fluid that has been supplied to the recess is drained. In this configuration, the lock control valve is switched to the unlocked position when the supply of electric power to the lock control valve is stopped, and the lock control valve is switched to the locked position when electric power is supplied to the lock control valve. If, as in this configuration, the lock control valve is set to the unlocked position in a state in which the supply of electric power has been stopped, it is possible to save power consumption when changing the relative rotation phase by maintaining the unlocked position.

In another characteristic configuration of the present invention, the valve opening/closing timing control device includes a recess provided in the driven-side rotating body; a lock release channel that links the fluid pump with the recess; and a lock control valve that, in response to a supplied electric current, is capable of switching between an unlocked position that is a state in which the working fluid that has been discharged from the fluid pump is supplied from the lock release channel to the recess, and a locked position that is a state in which the working fluid that has been supplied to the recess is drained. In this configuration, the lock control valve is switched to the locked position when the supply of electric power to the lock control valve is stopped, and the lock control valve is switched to the unlocked position when electric power is supplied to the lock control valve. If, as in this configuration, the lock control valve is set to the locked position in a state in which the supply of electric power has been stopped, it is not necessary to switch the lock control valve when starting the engine, so restriction to the intermediate lock phase can be quickly realized.

DESCRIPTION OF EMBODIMENTS

Below, embodiments of the present invention will be described based on the drawings.

First Embodiment

Figure 1:
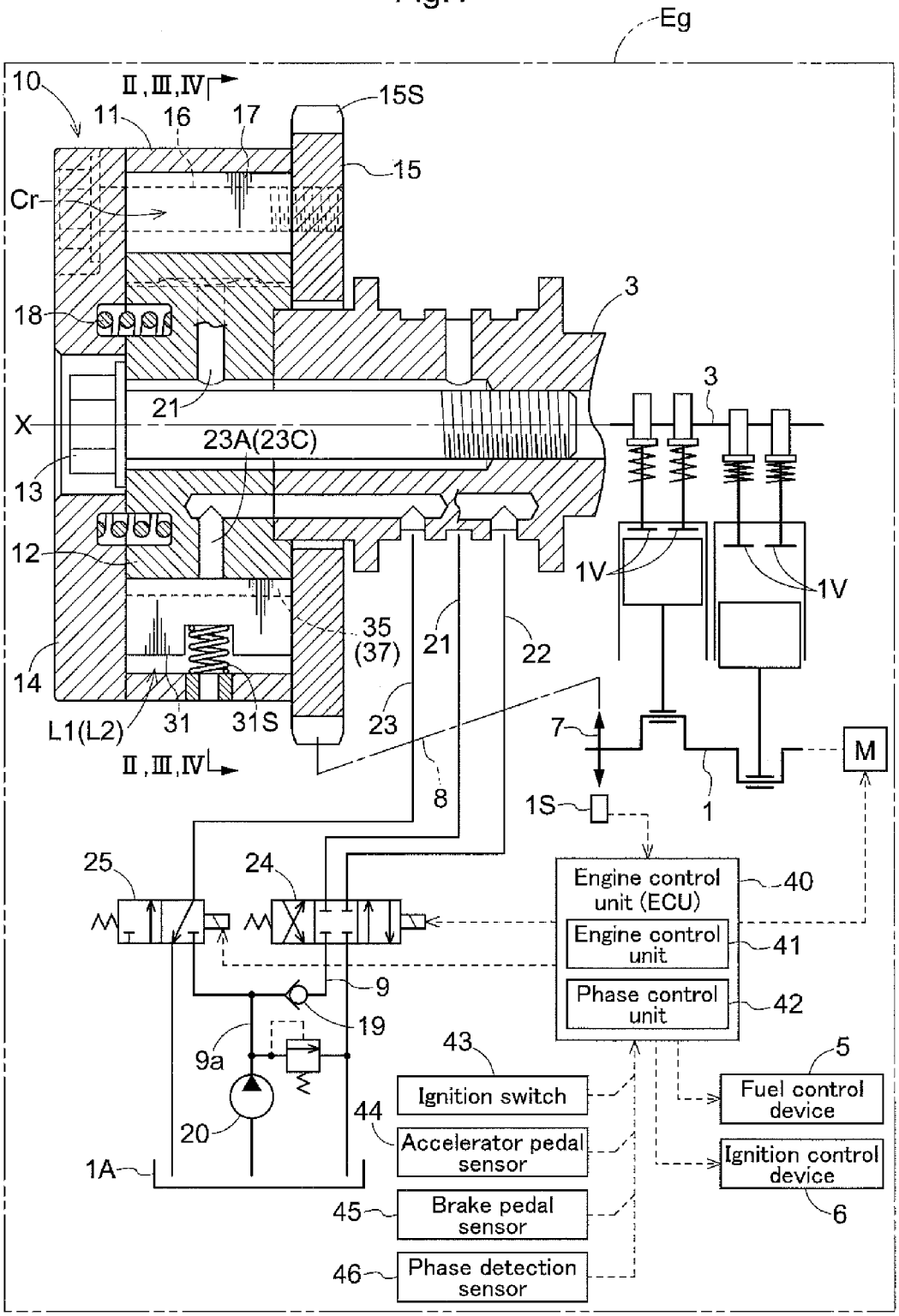
FIG. 1 is a vertical cross-sectional view that shows a configuration of a valve opening/closing timing control device according to a first embodiment.
Figure 2:
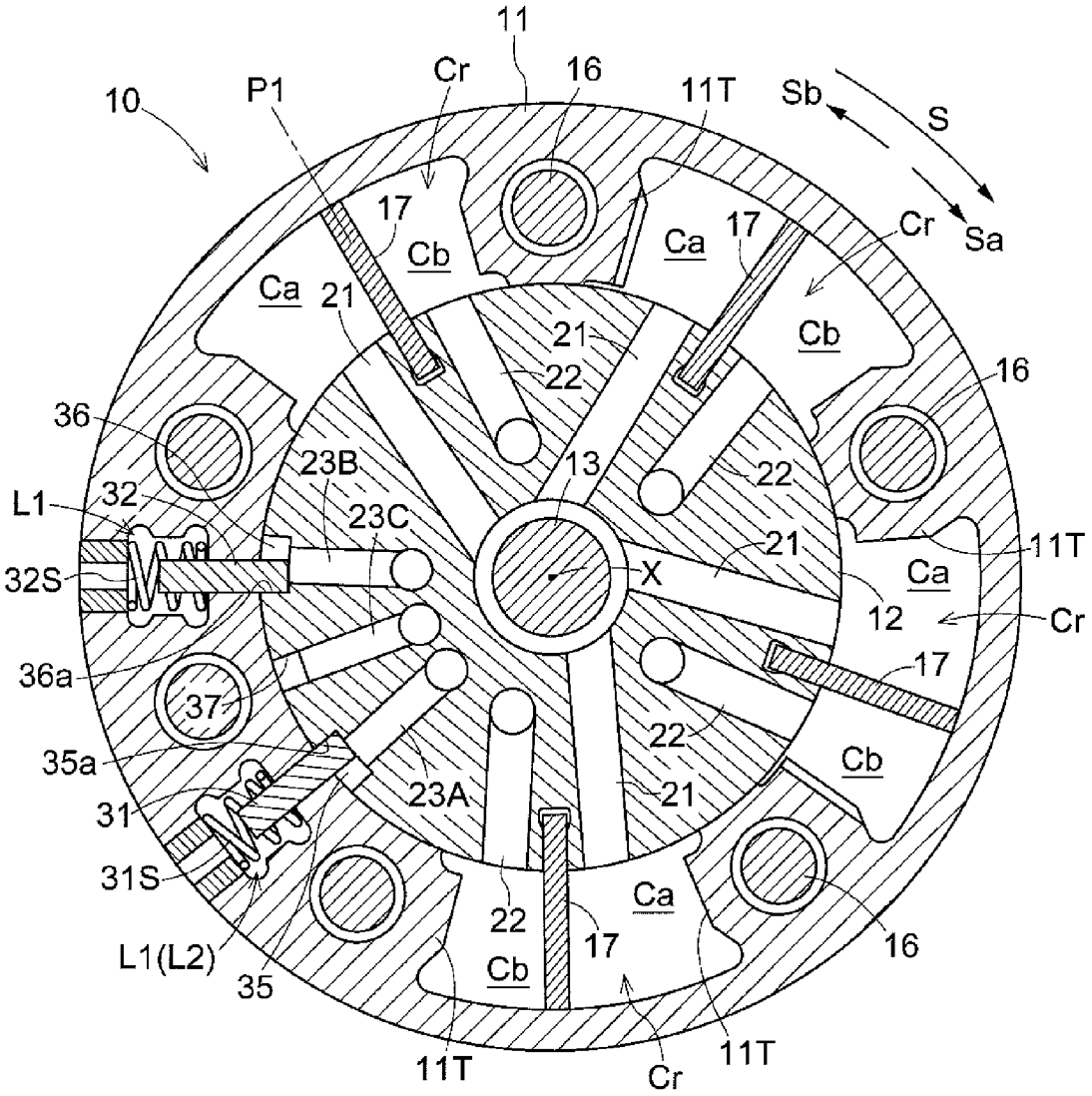
FIG. 2 is a cross-sectional view taken along line II-II in FIG. 1, and shows a state of locking at an intermediate lock phase.
Figure 3:
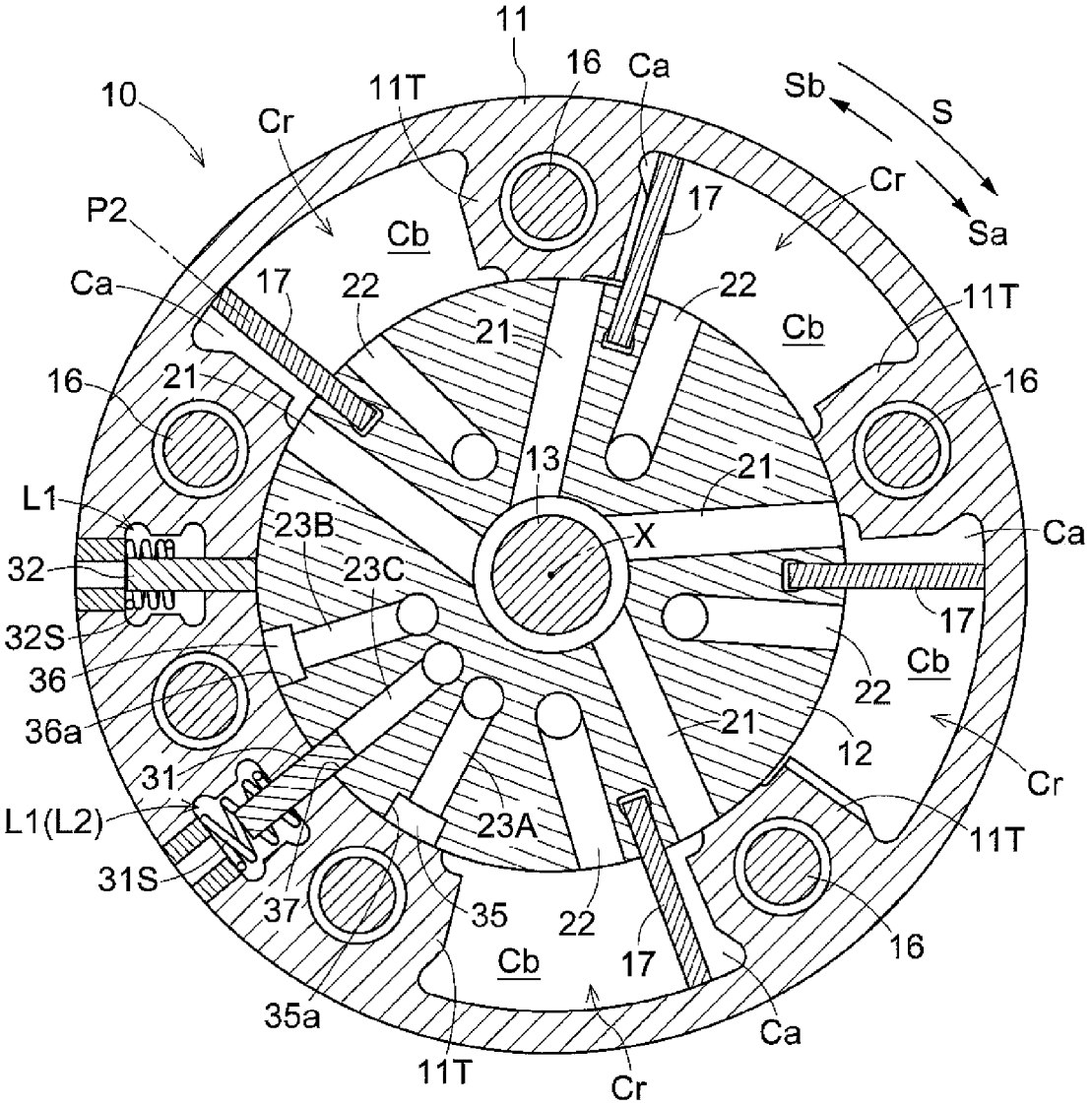
FIG. 3 is a cross-sectional view taken along line in FIG. 1, and shows a state of locking at a most delayed lock phase.

FIGS. 1 to 5 show a valve opening/closing timing control device 10 according to the present embodiment. FIG. 1 shows a vertical cross-sectional view of the valve opening/closing timing control device 10, together with a hydraulic circuit diagram and a control block diagram. FIG. 2 shows a state of locking at an intermediate lock phase P1, and FIG. 3 shows a state of locking at a most delayed phase P2.

[Basic Configuration]

The valve opening/closing timing control device 10 is installed in an automobile engine Eg serving as an internal combustion engine, and controls an opening/closing timing of an intake valve (not shown) of the engine Eg with an engine control unit (referred to below as an 'ECU') 40.

The engine Eg is provided with a starter motor M that confers a cranking torque to a crankshaft 1, a fuel control device 5 that controls a fuel injection operation, an ignition control device 6 that controls a spark plug (not shown) ignition operation, and a shaft sensor 1S that detects a rotation angle and a rotational speed of the crankshaft 1.

The ECU 40 is provided with an engine control unit 41 that controls the running state of the engine Eg, and a phase control unit 42 that controls a relative rotation phase of a driven-side rotating body with respect to a drive-side rotating body.

[Valve Opening/Closing Timing Control Device]

As shown in FIG. 1, the valve opening/closing timing control device 10 is provided with an external rotor 11 serving as a drive-side rotating body that rotates synchronously with the crankshaft 1, an internal rotor 12 serving as a driven-side rotating body that rotates synchronously with a valve opening/closing camshaft 3 that opens/closes an intake valve and is linked to the camshaft 3 with a linking bolt 13, and a phase detection sensor 46 that detects a relative rotation phase of the internal rotor 12 with respect to the external rotor 11 (referred to hereinafter as simply the 'relative rotation phase'). The external rotor 11 and the internal rotor 12 are disposed coaxially on the same axis as a center axis X of the camshaft 3, and are supported so as to be capable of rotating relative to each other around the center axis X.

The phase detection sensor 46 encompasses not only a sensor that directly detects the relative rotation phase, but also, for example, a sensor that is capable of indirectly calculating the relative rotation phase, like a cam angle sensor.

The external rotor 11 is fastened with a fastening bolt 16 between a front plate 14 and a rear plate 15. A timing sprocket 15S is formed as a single body with the rear plate 15 at the outer circumferential side of the rear plate 15. The camshaft 3 is linked to one end side of the internal rotor 12 and is supported in a state penetrating through an opening portion formed in the rear plate 15.

As shown in FIGS. 2 and 3, in the external rotor 11 a plurality of protruding portions 11T that protrude toward the inside in the diameter direction are formed as a single body with the external rotor 11. The internal rotor 12 is formed in a column-like shape having an outer circumferential face that fits closely with protruding ends of the plurality of protruding portions 11T. Thus, an area between the external rotor 11 and the internal rotor 12 is divided by the protruding portions 11T, thereby forming a plurality of fluid pressure chambers Cr that are adjacent in the rotational direction.

On the outer circumferential side of the internal rotor 12, a plurality of vanes 17 serving as dividing portions are provided inserted so as to protrude toward the inner circumferential side of the external rotor 11. By dividing each fluid pressure chamber Cr with a vane 17, an advance chamber Ca and a delay chamber Cb that are adjacent in the rotational direction are formed as sections.

As shown in FIGS. 2 and 3, the external rotor 11 rotates synchronously with the crankshaft 1 in a drive rotation direction S. With respect to the external rotor 11, a direction that the internal rotor 12 rotates that is the same as the drive rotation direction S is referred to as an advance direction Sa, and a rotational direction in the opposite direction as the advance direction Sa is referred to as a delay direction Sb.

In the valve opening/closing timing control device 10, the crankshaft 1 and the camshaft 3 are linked such that the intake compression ratio increases as the relative rotation phase is displaced to the side of the advance direction Sa, and the intake compression ratio decreases as the relative rotation phase is displaced to the side of the delay direction Sb.

As shown in FIG. 1, a torsion spring 18 that biases the internal rotor 12 to shift in the advance direction Sa with respect to the external rotor 11 is installed across the internal rotor 12 and the front plate 14.

The external rotor 11 and the crankshaft 1 are linked so as to rotate synchronously by a timing chain 8 wrapped around an output sprocket 7 and the timing sprocket 15S.

The relative rotation phase is displaced to the side of the advance direction Sa by supplying the working fluid to the advance chamber Ca, and is displaced to the side of the delay direction Sb by supplying the working fluid to the delay chamber Cb. The relative rotation phase when the vane 17 has arrived at an end of shifting (end of swinging around the center axis X) in the advance direction Sa is called a most advanced phase, and the relative rotation phase when the vane 17 has arrived at an end of shifting (end of swinging around the center axis X) in the delay direction Sb is called a most delayed phase.

The most advanced phase is a concept that encompasses not only the end of shifting in the advance direction Sa by the vane 17, but also the vicinity of this end of shifting. Likewise, the most delayed phase is a concept that encompasses not only the end of shifting in the delay direction Sb by the vane 17, but also the vicinity of this end of shifting.

Formed in the internal rotor 12 are an advance channel 21 that selectively permits supply of the working fluid to the advance chamber Ca and outflow of the working fluid from the advance chamber Ca, a delay channel 22 that selectively permits supply of the working fluid to the delay chamber Cb and outflow of the working fluid from the delay chamber Cb, and a lock release channel 23 that supplies a lock release working fluid to a lock mechanism described later.

The lock release channel 23 is formed as a separate independent channel from the advance channel 21 and the delay channel 22.

An oil pump 20 serving as a fluid pump that is driven by the engine Eg sucks out lubricating oil that accumulates in an oil pan 1A of the engine Eg, and supplies this oil to the advance chamber Ca or the delay chamber Cb as the working fluid.

[Lock Mechanism]

The valve opening/closing timing control device 10 includes an intermediate lock mechanism L1 and a most delayed lock mechanism L2. The intermediate lock mechanism L1 is provided so as to be capable of selectively switching between a locked state that restricts the relative rotation phase to the intermediate lock phase P1 shown in FIG. 2 and an unlocked state in which the restriction has been released. The most delayed lock mechanism L2 is provided so as to be capable of switching between a locked state that restricts the relative rotation phase to the most delayed phase P2 shown in FIG. 3 and an unlocked state in which the restriction has been released.

The intermediate lock phase P1 is a phase where the relative rotation phase is between the most advanced phase where the volume of the advance chamber Ca is greatest and the most delayed phase P2 where the volume of the delay chamber Cb is greatest, and at this phase the engine Eg can be started well when in a low temperature state. The most delayed phase P2 is a phase where the engine Eg can be cranked with low torque when the engine Eg is currently stopped at a high temperature state (a state in which time has not passed since stoppage of the engine Eg).

As shown in FIGS. 2 and 3, the intermediate lock mechanism L1 and the most delayed lock mechanism L2 include a first lock member 31 and a second lock member 32 that have been provided in the external rotor 11, a first recess 35, a second recess 36, and a third recess 37 that have been provided in the internal rotor 12, and the lock release channel 23 that supplies the lock release working fluid to each of the first recess 35, the second recess 36, and the third recess 37.

The first lock member 31 and the second lock member 32 are formed in a plate-like shape, and are installed in the external rotor 11 so as to be capable of entering into or withdrawing from the internal rotor 12, in an attitude parallel to the center axis X. In the first lock member 31, a first spring (biasing member) 31S is installed that biases the first lock member 31 so as to enter into the first recess 35 or the third recess 37. In the second lock member 32, a second spring (biasing member) 32S is installed that biases the second lock member 32 so as to enter into the second recess 36.

In the intermediate lock mechanism L1, as shown in FIG. 2, in a locked state in which the relative rotation phase is restricted to the intermediate lock phase P1, the first lock member 31 has entered into the first recess 35 in a state in contact with an inner face portion 35*a* that forms an end in the advance direction Sa, and the second lock member 32 has entered into the second recess 36 in a state in contact with an inner face portion 36*a* that forms an end in the delay direction Sb.

In the most delayed lock mechanism L2, as shown in FIG. 3, in a locked state in which the relative rotation phase is restricted to the most delayed phase P2, the first lock member 31 has entered into the third recess 37, which is formed at a position between the first recess 35 and the second recess 36.

The lock release channel 23 is formed in the internal rotor 12, and as shown in FIGS. 2 and 3, is branched into a first release channel 23A that supplies/drains the working fluid to/from the first recess 35, a second release channel 23B that supplies/drains the working fluid to/from the second recess 36, and a third release channel 23C that supplies/drains the working fluid to/from the third recess 37.

[Fluid Control Mechanism]

As shown in FIG. 1, a phase control valve 24 that is capable of selectively switching the supply destination of the working fluid that has been discharged from the oil pump 20 to either the advance chamber Ca or the delay chamber Cb, and a lock control valve 25 that is capable of switching between a state (an unlocked position) in which the working fluid that has been discharged from the oil pump 20 is supplied from the lock release channel 23 to the first to third recesses 35, 36, and 37 and a state (a locked position) in which the working fluid that has been supplied to the first to third recesses 35, 36, and 37 is drained to the oil pan 1A via the lock release channel 23, are provided. A fluid control mechanism is configured collectively with the oil pump 20, the phase control valve 24, the lock control valve 25, and the channels that supply/drain the working fluid.

The phase control valve 24 is configured with an electromagnetic valve capable of a switching operation to switch among an advance position, a delay position, and a neutral position according to the strength of electric current of a power source.

Figure 5:
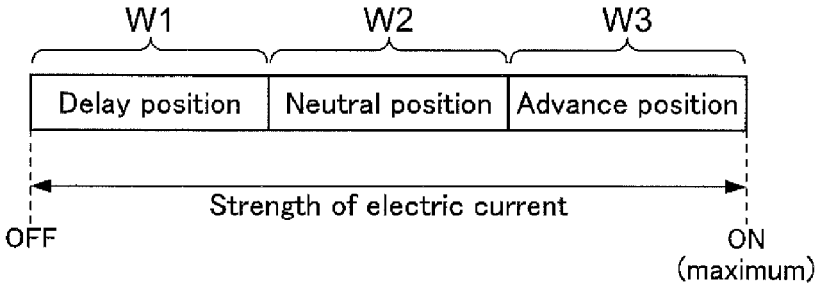
FIG. 5 shows an exemplary operational configuration of a phase control valve.

In the phase control valve 24, as shown in FIG. 5, a spool position changes from a position W1 to a position W3 according to the strength of electric current applied, and the working fluid supply destination is held at the delay chamber Cb in a power off state in which supply of electric power has been severed. At position W1 the phase control valve 24 is switched to the delay position where the working fluid supply destination has been switched to the delay chamber Cb, at position W2 the phase control valve 24 is switched to the neutral position where the working fluid is not supplied to the advance chamber Ca or the delay chamber Cb, and at position W3 the phase control valve 24 is switched to the advance position where the working fluid supply destination has been switched to the advance chamber Ca.

At the advance position, the working fluid discharged from the oil pump 20 is supplied from the advance channel 21 to the advance chamber Ca, and the working fluid in the delay chamber Cb is drained from the delay channel 22. At the delay position, the working fluid discharged from the oil pump 20 is supplied from the delay channel 22 to the delay chamber Cb, and the working fluid in the advance chamber Ca is drained from the advance channel 21. In the neutral position, the working fluid is not supplied to or drained from either the advance chamber Ca or the delay chamber Cb.

The lock control valve 25 is configured with an electromagnetic valve capable of a switching operation to switch among an unlocked position and a locked position by a power source switching on/off. The lock control valve 25 is switched to the locked position by the power source switching on and is switched to the unlocked position by the power source switching off.

Accordingly, during a stoppage of the engine Eg, it is possible to achieve a reduction in power consumption by holding the lock control valve 25 at the unlocked position, to which the lock control valve 25 was switched by the power source switching off.

In the unlocked position, the working fluid discharged from the oil pump 20 is supplied to the first recess 35, the second recess 36, and the third recess 37 via the lock release channel 23.

Accordingly, when the lock control valve 25 is switched to the unlocked position from a locked state in which the relative rotation phase has been restricted to the intermediate lock phase P1, the first lock member 31 and the second lock member 32 are withdrawn from the first recess 35 and the second recess 36 due to the fluid pressure of the working fluid acting against the biasing force of the first spring 31S and the second spring 32S, thus switching to an unlocked state.

Alternatively, when the lock control valve 25 is switched to the unlocked position from a locked state in which the relative rotation phase has been restricted to the most delayed phase P2, the first lock member 31 is withdrawn from the third recess 37 due to the fluid pressure of the working fluid acting against the biasing force of the first spring 31S, thus switching to the unlocked state.

When the lock control valve 25 is switched from the unlocked position to the locked position, the working fluid that has been supplied to the first recess 35, the second recess 36, and the third recess 37 is drained from the lock release channel 23.

Accordingly, in a state of having switched to the locked position, when the relative rotation phase arrives at the intermediate lock phase P1, the first lock member 31 enters into the first recess 35 due to the biasing force of the first spring 31S, and the second lock member 32 enters into the second recess 36 due to the biasing force of the second spring 32S, thus switching to the locked state in which the relative rotation phase has been restricted to the intermediate lock phase P1.

Alternatively, in a state of having switched to the locked position, when the relative rotation phase arrives at the most delayed phase P2, the first lock member 31 enters into the third recess 37 due to the biasing force of the first spring 31S, thus switching to the locked state in which the relative rotation phase has been restricted to the most delayed phase P2.

In a connection channel 9 that connects the oil pump 20 with the phase control valve 24, a non-return valve 19 is provided that blocks flow (return flow) of the working fluid from the phase control valve 24 to the oil pump 20. The lock control valve 25 is branched from a connection channel portion 9*a* that is between the oil pump 20 and the non-return valve 19, and is connected to the oil pump 20.

[Control Configuration]

As shown in FIG. 1, signals from the shaft sensor 1S, an ignition switch 43, an accelerator pedal sensor 44, a brake pedal sensor 45, and the phase detection sensor 46 are input to the ECU 40. The ECU 40 outputs signals that control each of the starter motor M, the fuel control device 5, and the ignition control device 6, and also outputs signals that control operation of the phase control valve 24 and the lock control valve 25.

The engine control unit 41 starts the engine Eg by an ON operation of the ignition switch 43, and stops the engine Eg by an OFF operation of the ignition switch 43. The accelerator pedal sensor 44 detects an amount of stepping on an accelerator pedal (not shown), and the brake pedal sensor 45 detects stepping on a brake pedal (not shown).

The phase control unit 42 performs timing control of an intake valve by the valve opening/closing timing control device 10 during running of the engine Eg, and when stopping the engine Eg, moves the relative rotation phase to the intermediate lock phase P1 and then locks the relative rotation phase. In the phase control unit 42, when the phase detection sensor 46 detects that the relative rotation phase moved past the intermediate lock phase P1 during movement of the relative rotation phase to the intermediate lock phase P1, the direction of change of the relative rotation phase is reversed by changing the working fluid supply destination with the phase control valve 24, and so swift movement to the intermediate lock phase P1 is achieved.

Operation to control the relative rotation phase when starting the engine by the phase control unit 42 will be described based on the timing chart shown in FIG. 6. Note that in FIG. 6, in order to describe the first embodiment and a later-described third embodiment, the lock control valve 25 used to configure the first embodiment and a lock control valve 25 used to configure the third embodiment are both shown.

Figure 6:
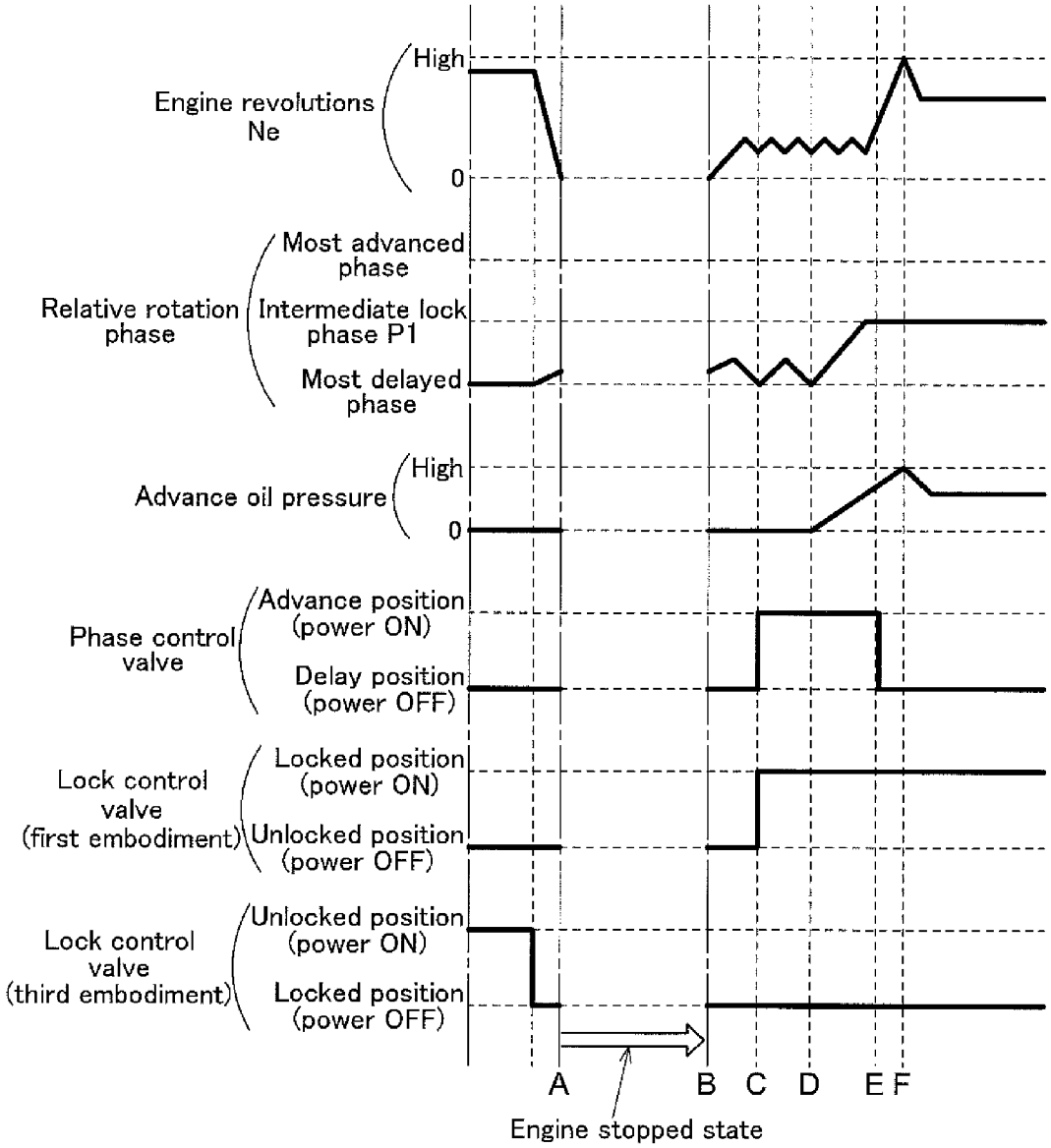
FIG. 6 is a timing chart that shows a relative rotation phase control operation according to a first embodiment (third embodiment).

Therefore, in FIG. 6, the lock control valve 25 used to configure the first embodiment is indicated by "lock control valve (first embodiment)" and the lock control valve 25 used to configure the third embodiment is indicated by "lock control valve (third embodiment)".

The timing chart shown in FIG. 6 assumes a case where the engine Eg was stopped by an engine stall during running (for example during running in an idling state) at a higher number of engine revolutions Ne than during normal stoppage of the engine Eg, which is about 1000 rpm, for example.

During this sort of running of the engine Eg, the phase control valve 24 is held at the delay position so the oil pressure of the advance chamber Ca (referred to below as an advance oil pressure) is not elevated, and also, the lock control valve (first embodiment) 25 is held at the unlocked position set by the power source switching off, so the relative rotation phase is held at the most delayed phase P2 in the unlocked state.

Time A shown in FIG. 6 indicates a time when the engine Eg running in such a state was stopped by an engine stall.

Figure 4:
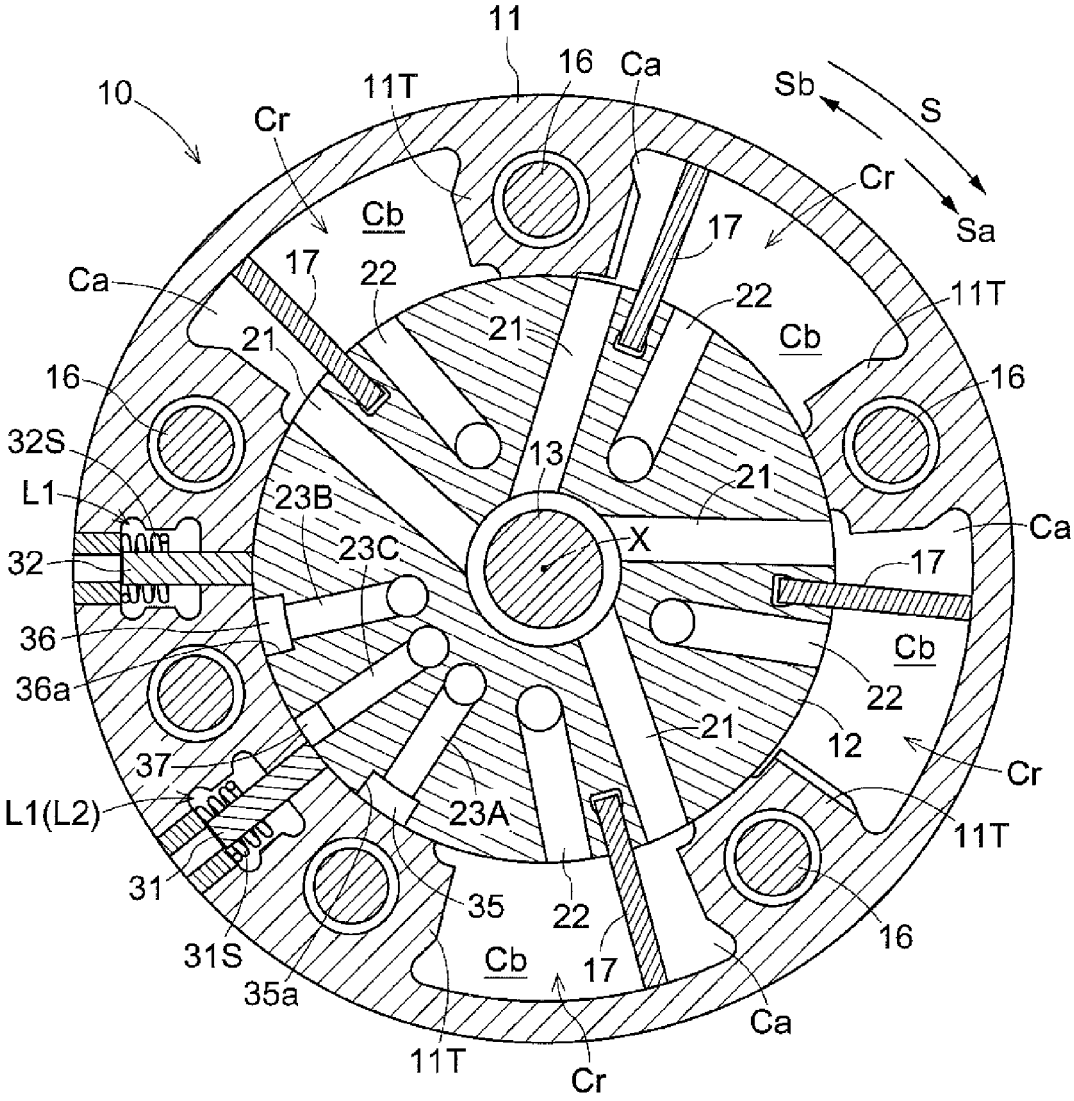
FIG. 4 is a cross-sectional view taken along line IV-IV in FIG. 1, and shows a relative rotation phase at a time A when an engine was stopped.

At time A, in the valve opening/closing timing control device 10, the phase control valve 24 is held at the delay position set by the power source switching off, and for example, as shown in FIG. 4, the relative rotation phase is being held at a phase between the most delayed phase P2 and the intermediate lock phase P1.

At time B after the engine Eg has been left as-is in a stopped state, the starter motor M is driven by operation of the ignition switch 43, thus starting cranking that causes the crankshaft 1 to rotate.

At time C immediately after starting cranking which is the start-up time of the engine Eg, the phase detection sensor 46 detects that the relative rotation phase is positioned toward the most delayed phase P2 with respect to the intermediate lock phase P1. In this case, the phase control unit 42 issues a command to apply an electric current to the phase control valve 24 such that the working fluid supply destination is switched to the supply destination where the internal rotor 12 shifts toward the intermediate lock phase P1 with respect to the external rotor 11, that is, the working fluid supply destination is switched to the advance chamber Ca. Thus, the phase control valve 24 is switched to the advance position by the power source switching on. Also, the lock control valve (first embodiment) 25 is switched to the locked position by the power source switching on.

A time lag occurs from time C when the phase control valve 24 is switched to the advance position until time D when the advance oil pressure starts to increase. At time E after passage of a predetermined time period following time C and before the engine Eg is started, when the phase detection sensor 46 detects that the relative rotation phase is at the intermediate lock phase P1, or that the internal rotor 12 has shifted to the advance side past the intermediate lock phase P1 with respect to the external rotor 11, the phase control valve 24 is switched to the delay position by the power source switching off.

At time C the phase control valve 24 is switched to the advance position, and the lock control valve (first embodiment) 25 is switched to the locked position, so normally, the relative rotation phase can be restricted to the intermediate lock phase P1.

However, in a case where the relative rotation phase cannot be restricted to the intermediate lock phase P1, and at time E the phase detection sensor 46 detected that the internal rotor 12 has shifted past the intermediate lock phase P1 and toward the most advanced phase with respect to the external rotor 11, the phase control unit 42 issues a command for the power source of the phase control valve 24 to be switched off. Thus, it is possible to perform an operation to switch the phase control valve 24 to the delay position and return the relative rotation phase to the intermediate lock phase P1.

Therefore, the relative rotation phase can be reliably restricted to the intermediate lock phase P1.

At time F when the engine Eg has been started, the number of engine revolutions Ne temporarily increases, so the advance oil pressure also temporarily rises to a high oil pressure of about 100 kPa.

Second Embodiment

FIGS. 7 to 10 show another embodiment of the present invention.

Figure 7:
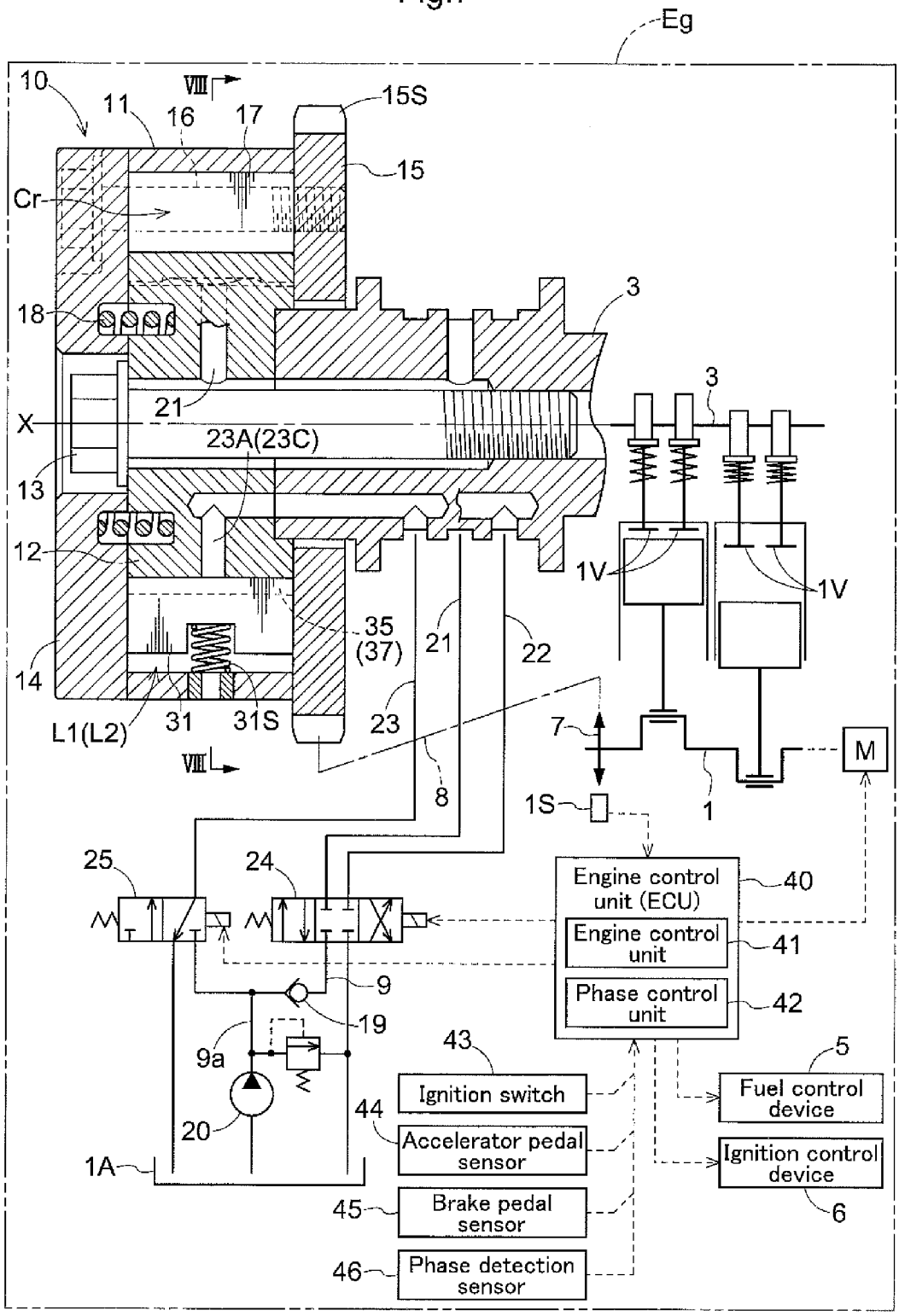
FIG. 7 is a vertical cross-sectional view that shows the configuration of a valve opening/closing timing control device according to a second embodiment.

As shown in FIG. 7, the valve opening/closing timing control device 10 of the present embodiment is provided with a phase control valve (electromagnetic valve) 24 configured such that the working fluid supply destination is held at the advance chamber Ca in a power off state in which supply of electric power has been severed.

Figure 9:
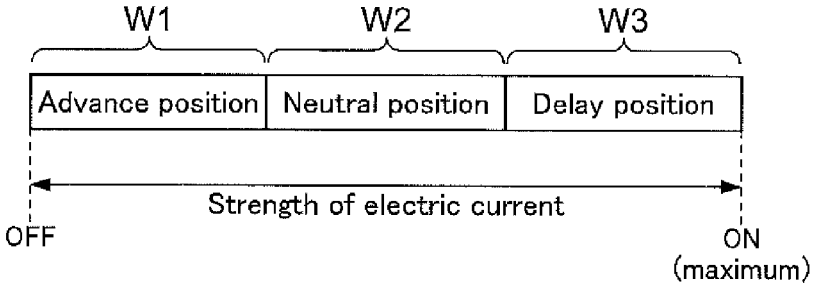
FIG. 9 shows an exemplary operational configuration of a phase control valve according to a second embodiment.

In the phase control valve 24, as shown in FIG. 9, a spool position changes from a position W1 to a position W3 according to the strength of electric current applied, so that the working fluid supply destination is held at the advance chamber Ca in a power off state in which supply of electric power has been severed. At position W1 the phase control valve 24 is switched to the advance position where the working fluid supply destination has been switched to the advance chamber Ca, at position W2 the phase control valve 24 is switched to the neutral position where the working fluid is not supplied to the advance chamber Ca or the delay chamber Cb, and at position W3 the phase control valve 24 is switched to the delay position where the working fluid supply destination has been switched to the delay chamber Cb.

Operation to control the relative rotation phase when starting the engine by the phase control unit 42, in the present embodiment, will be described based on the timing chart shown in FIG. 10. Note that in FIG. 10, in order to describe the second embodiment and the later-described third embodiment, the lock control valve 25 used to configure the second embodiment and the lock control valve 25 used to configure the third embodiment are both shown.

Figure 10:
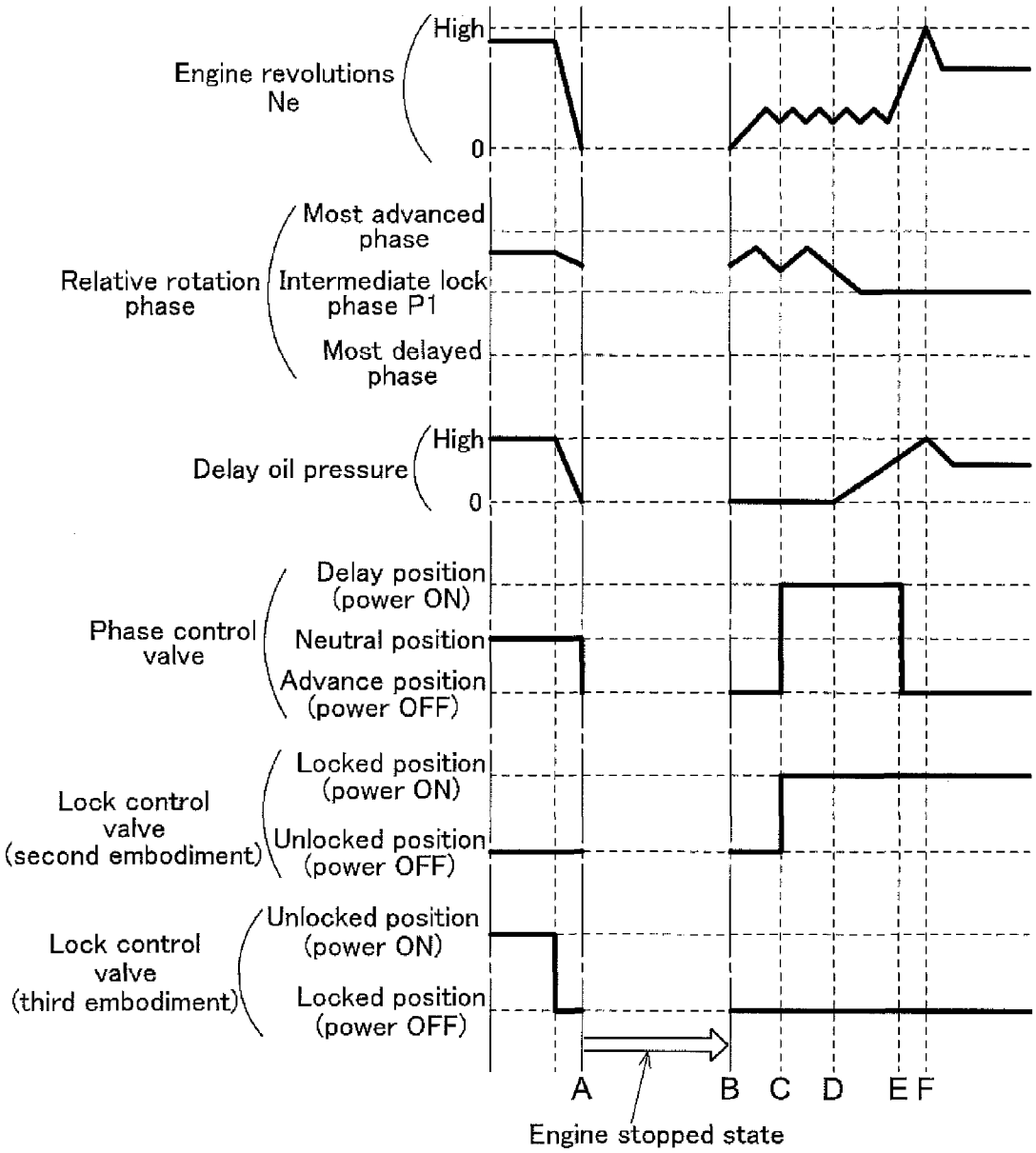
FIG. 10 is a timing chart that shows a relative rotation phase control operation according to a second embodiment (third embodiment).

Therefore, in FIG. 10, the lock control valve 25 used to configure the second embodiment is indicated by "lock control valve (second embodiment)" and the lock control valve 25 used to configure the third embodiment is indicated by "lock control valve (third embodiment)".

The timing chart shown in FIG. 10 assumes a case where the engine Eg was stopped by an engine stall during running (for example during running in an idling state) at a higher number of engine revolutions Ne than during normal stoppage of the engine Eg, which is about 1000 rpm, for example.

During this sort of running of the engine Eg, the phase control valve 24 is held at the neutral position so the oil pressure of the delay chamber Cb (referred to below as a delay oil pressure) is maintained at a high oil pressure of about 100 kPa, and also, the lock control valve (second embodiment) 25 is held at the unlocked position set by the power source switching off, so the relative rotation phase is held at a phase between the most advanced phase and the intermediate lock phase P1.

Time A shown in FIG. 10 indicates a time when the engine Eg running in such a state was stopped by an engine stall.

Figure 8:
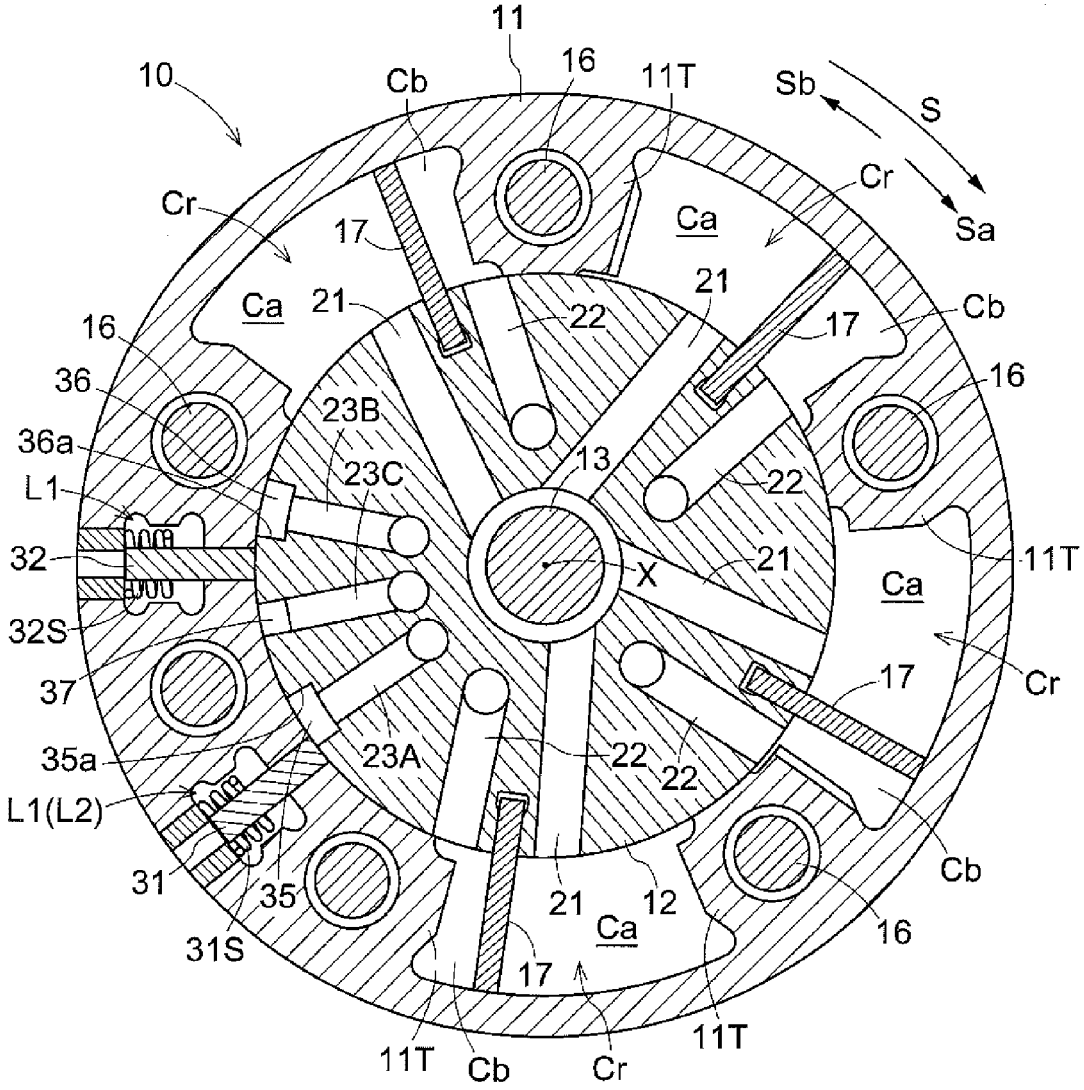
FIG. 8 is a cross-sectional view taken along line VIII-VIII in FIG. 7, and shows a relative rotation phase at a time A when an engine was stopped.

At time A, in the valve opening/closing timing control device 10, the phase control valve 24 is held at the advance position set by the power source switching off, and as shown in FIG. 8, the relative rotation phase is being held at a phase between the most advanced phase and the intermediate lock phase P1.

At time B after the engine Eg has been left as-is in a stopped state, the starter motor M is driven by operation of the ignition switch 43, thus starting cranking that causes the crankshaft 1 to rotate.

At time C immediately after starting cranking which is the start-up time of the engine Eg, the phase detection sensor 46 detects that the relative rotation phase is positioned toward the most advanced phase with respect to the intermediate lock phase P1. In this case, the phase control unit 42 issues a command to apply an electric current to the phase control valve 24 such that the working fluid supply destination is switched to the supply destination where the internal rotor 12 shifts toward the intermediate lock phase P1 with respect to the external rotor 11, that is, the working fluid supply destination is switched to the delay chamber Cb. Thus, the phase control valve 24 is switched to the delay position by the power source switching on. Also, the lock control valve (second embodiment) 25 is switched to the locked position by the power source switching on.

A time lag occurs from time C when the phase control valve 24 is switched to the delay position until time D when the delay oil pressure starts to increase. At time E after passage of a predetermined time period following time C and before the engine Eg is started, when the phase detection sensor 46 detects that the relative rotation phase is at the intermediate lock phase P1, or that the internal rotor 12 has shifted to the delay side past the intermediate lock phase P1 with respect to the external rotor 11, the phase control valve 24 is switched to the advance position by the power source switching off.

At time C the phase control valve 24 is switched to the delay position, and the lock control valve (second embodiment) 25 is switched to the locked position, so normally, the relative rotation phase can be restricted to the intermediate lock phase P1.

However, in a case where the relative rotation phase cannot be restricted to the intermediate lock phase P1, and at time E the phase detection sensor 46 detected that the internal rotor 12 has shifted past the intermediate lock phase P1 and toward the most delayed phase P2 with respect to the external rotor 11, the phase control unit 42 issues a command for the power source of the phase control valve 24 to be switched off. Thus, it is possible to switch the phase control valve 24 to the advance position and return the relative rotation phase to the intermediate lock phase P1.

Therefore, the relative rotation phase can be reliably restricted to the intermediate lock phase P1.

Other details of the configuration in the second embodiment are similar to those in the first embodiment.

Third Embodiment

Although not shown, in the first embodiment or the second embodiment, a lock control valve 25 may be provided that is capable of switching to the locked position by a power source switching off, and to the unlocked position by the power source switching on.

If such a lock control valve 25 is provided, during a stoppage of the engine Eg it is possible to hold the lock control valve 25 at the locked position to which the lock control valve 25 was switched by the power source switching off, so that when starting the engine Eg, the relative rotation phase is reliably restricted to the intermediate lock phase P1, where the engine Eg can start well even in a low temperature state.

The timing of switching on/off the power source of the lock control valve 25 used to configure the present embodiment is different than for the lock control valve 25 used to configure the first embodiment or the second embodiment.

Operation to control the relative rotation phase when starting the engine by the phase control unit 42 in the present embodiment is described using the timing charts shown in FIGS. 6 and 10. Note that in FIGS. 6 and 10, the lock control valve 25 used to configure the present embodiment is indicated by "lock control valve (third embodiment)".

Specifically, when starting the engine the phase control unit 42 controls the relative rotation phase by the same operation as in the first embodiment or the second embodiment, except that the lock control valve (third embodiment) 25 is switched to the locked position by the power source switching off due to the engine Eg being stopped by an engine stall.

Other details of the configuration in the third embodiment are similar to those in the first embodiment or the second embodiment.

INDUSTRIAL APPLICABILITY

The present invention is applicable to valve opening/closing timing control devices that control the opening/closing timing of intake/exhaust valves in various internal combustion engines.

REFERENCE SIGNS LIST

1: crankshaft
3: camshaft
11: drive-side rotating body
12: driven-side rotating body
17: dividing portion
19: non-return valve
20: fluid pump
21: advance channel
22: delay channel
24: electromagnetic valve
42: control unit
46: phase detection sensor
Cr: fluid pressure chamber
Ca: advance chamber
Cb: delay chamber
Eg: internal combustion engine
L1: intermediate lock mechanism
P1: intermediate lock phase

The invention claimed is:

1. A valve opening/closing timing control device, comprising:

a drive-side rotating body that rotates synchronously with a crankshaft of an internal combustion engine;

a driven-side rotating body that is disposed coaxially to the drive-side rotating body and rotates synchronously with a valve opening/closing camshaft of the internal combustion engine;

a fluid pressure chamber that is formed as a section between the drive-side rotating body and the driven-side rotating body;

an advance chamber and a delay chamber that are formed by dividing the fluid pressure chamber with a dividing portion that has been provided in at least one of the drive-side rotating body and the driven-side rotating body;

an advance channel that selectively permits supply of a working fluid to the advance chamber and outflow of the working fluid from the advance chamber;

a delay channel that selectively permits supply of the working fluid to the delay chamber and outflow of the working fluid from the delay chamber;

an intermediate lock mechanism that is capable of selectively switching between a locked state in which a relative rotation phase of the driven-side rotating body with respect to the drive-side rotating body is restricted to an intermediate lock phase between a most advanced phase and a most delayed phase, and an unlocked state in which the restriction has been released;

an electromagnetic valve that is capable of selectively switching a supply destination of a working fluid that has been discharged from a fluid pump to the advance chamber or the delay chamber according to the strength of electric current of a power source;

a phase detection sensor that is capable of detecting the relative rotation phase; and a control unit that issues a command to the electromagnetic valve to switch the working fluid supply destination to a working fluid supply destination at which the driven-side rotating body shifts toward the intermediate lock phase, in a case where supply of electric power to the electromagnetic valve is stopped and the working fluid supply destination is the delay chamber, when the relative rotation phase that has been detected by the phase detection sensor when starting the internal combustion engine is positioned toward the most delayed phase with respect to the intermediate lock phase, or in a case where the supply of electric power to the electromagnetic valve is stopped and the working fluid supply destination is the advance chamber, when the relative rotation phase that has been detected by the phase detection sensor when starting the internal combustion engine is positioned toward the most advanced phase with respect to the intermediate lock phase.

2. The valve opening/closing timing control device according to claim 1, further comprising:

a non-return valve that blocks flow of the working fluid from the electromagnetic valve to the fluid pump.

3. The valve opening/closing timing control device according to claims 1, wherein the control unit stops the supply of electric power to the electromagnetic valve when the driven-side rotating body has passed the intermediate lock phase due to the working fluid supply destination having been switched to the working fluid supply destination at which the driven-side rotating body shifts toward the intermediate lock phase.

4. The valve opening/closing timing control device according to claim 1, further comprising:

a recess provided in the driven-side rotating body;

a lock release channel that links the fluid pump with the recess; and a lock control valve that, in response to a supplied electric current, is capable of switching between an unlocked position that is a state in which the working fluid that has been discharged from the fluid pump is supplied from the lock release channel to the recess, and a locked position that is a state in which the working fluid that has been supplied to the recess is drained, wherein the lock control valve is switched to the unlocked position when the supply of electric power to the lock control valve is stopped, and the lock control valve is switched to the locked position when electric power is supplied to the lock control valve.

5. The valve opening/closing timing control device according to claim 1, further comprising:

a recess provided in the driven-side rotating body;

a lock release channel that links the fluid pump with the recess; and a lock control valve that, in response to a supplied electric current, is capable of switching between an unlocked position that is a state in which the working fluid that has been discharged from the fluid pump is supplied from the lock release channel to the recess, and a locked position that is a state in which the working fluid that has been supplied to the recess is drained, wherein the lock control valve is switched to the locked position when the supply of electric power to the lock control valve is stopped, and the lock control valve is switched to the unlocked position when electric power is supplied to the lock control valve.

* * * * *